US008398077B2

(12) United States Patent
Uehara et al.

(10) Patent No.: US 8,398,077 B2
(45) Date of Patent: Mar. 19, 2013

(54) RECORDING MEDIA STORAGE DEVICE, RECORDING MEDIA PROCESSING DEVICE, AND STORAGE DETECTION METHOD

(75) Inventors: Shigehiko Uehara, Shiojiri (JP); Toru Takami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1271 days.

(21) Appl. No.: 12/220,575

(22) Filed: Jul. 25, 2008

(65) Prior Publication Data

US 2009/0027733 A1 Jan. 29, 2009

(30) Foreign Application Priority Data

Jul. 25, 2007 (JP) ..... 2007-192989

(51) Int. Cl.
*B65H 31/20* (2006.01)

(52) U.S. Cl. ..... 271/220; 271/223

(58) Field of Classification Search ..... 271/145, 271/149, 152–154, 219, 220, 223, 160
See application file for complete search history.

(56) References Cited

U.S. PATENT DOCUMENTS 6,113,094 A * 9/2000 Horiguchi et al. ..... 271/176
2004/0257626 A1 12/2004 Panini et al.

FOREIGN PATENT DOCUMENTS

JP 48-014291 U 2/1973
JP 61153048 U 9/1986
JP 01176778 A 7/1989
JP 03-192065 A 8/1991
JP 10-226446 8/1998
JP 2004-206362 7/2004
JP 2004-206362 A 7/2004
JP 2004-214775 A 7/2004
JP 2005-035753 A 2/2005
JP 2005-053648 A 3/2005
JP 2007-091403 A 4/2007
JP 2007-119113 5/2007

OTHER PUBLICATIONS

European Search Report EP08013416 Feb. 22, 2010.
Extended European Search Report issued Jun. 5, 2012 for Application No. 08013416.6 (12 Pages).

* cited by examiner

*Primary Examiner* — Michael McCullough
(74) *Attorney, Agent, or Firm* — Nutter McClennen & Fish LLP; John J. Penny, Jr.; Michael P. Visconti, III

(57) ABSTRACT

A check processing device accurately detects if the check storage unit is full. The check storage unit 10 of a check processing device 1 has first and second storage pockets 13 and 14. A first vertical pressure plate 54, 64 and a second vertical pressure plate 55, 65 for holding the checks conveyed into the storage pockets 13 and 14 are disposed to the storage pockets 13 and 14. The first vertical pressure plates 54 and 64 are displaced according to the total thickness of the checks stored in the storage pockets 13 and 14. Using detection mechanisms 80 and 90 having an interrupter 81, 91 disposed to the corresponding first vertical pressure plate 54 and 64, and a photosensor 82, 92 for detecting the corresponding interrupter, the total thickness of the checks stored in the storage pockets 13 and 14 can be detected, and whether the storage unit is full can be detected from this total check thickness.

8 Claims, 5 Drawing Sheets

RECORDING MEDIA STORAGE DEVICE, RECORDING MEDIA PROCESSING DEVICE, AND STORAGE DETECTION METHOD

BACKGROUND OF THE INVENTION

1. Field of Invention

The present invention relates to a recording media storage device that stores recording media and is incorporated in a check processing device or other recording media processing device, to a recording media processing device that has this recording media storage device, and to a storage detection method that detects storage of recording media in the recording media storage device.

2. Description of Related Art

An example of a recording media processing device for processing recording media such as checks and other sheet media is a check processing device for processing checks. Such check processing devices are taught in United States Patent Application 2004/0257626 and in Japanese Unexamined Patent Appl. Pub. JP-A-2004-206362. These check processing devices have a supply unit in which the checks are loaded, a transportation path to which an image scanner and a magnetic head are disposed, and a check storage unit (sheet storage unit) for temporarily storing the checks or other sheet media delivered from the transportation path after the checks are imaged and the MICR line is read.

So that the check storage unit can store checks of different lengths and widths, the check storage unit is typically a pocket rendered as a rectangular slot of a specific width that is open on the top and one end. The checks or other slips discharged from the transportation path are stored stacked standing on edge and gradually filling the inside width of the pocket.

If checks continue to be fed into the check storage unit even though the check storage unit is full, the in-fed checks will become jammed. Removing jammed checks from the check storage unit must be done carefully in order to not damage the checks, and is therefore time-consuming. To prevent this problem, the number of checks fed into the check storage unit could be counted, for example, in order to detect when the check storage unit becomes full.

However, while the standard check thickness is 0.13 mm, checks of different thicknesses are also available, and check thickness ranges from approximately 0.09 mm to 0.2 mm. Some checks may have also been folded and creased. The check storage unit may therefore become full with fewer than the rated number of standard checks depending on the actual check thickness and whether any of the checks have been folded. Whether the check storage unit is full or not therefore cannot be reliably detected based only on the number of checks fed into the check storage unit.

Check processing devices therefore do not generally have a detection mechanism for detecting the check storage condition of the check storage unit, and typically rely on the operator to visually determine if the check storage unit is full.

The operator generally removes the checks before the check storage unit becomes full. This means that when the checks are batch processed in a continuous stream, the check storage unit can become full while the checks are being processed and conveyed, and the plural checks that continue to be conveyed after the check storage unit becomes full will jam near the entrance to the check storage unit. If checks jam, time is then taken as described above to remove the checks from the check storage unit, and the efficiency of the check processing operation drops accordingly. Checks may even be torn or otherwise damaged in the process.

SUMMARY OF THE INVENTION

The recording media storage device, recording media processing device, and storage detection method of at least one of embodiment of the present invention enable accurately detecting the storage condition, including whether the storage device is full.

A recording media storage device according to a first aspect of at least one of embodiment of the invention has a storage unit that has mutually opposing first and second side walls and is a slot of a predetermined depth for storing recording media; a media pressure member that presses recording media conveyed into the storage unit from the upstream end of the storage unit against the first side wall; and a detection mechanism that detects how much the media pressure member moves across the width of the storage unit.

The combined (total) thickness of the recording media stored in the storage unit can be detected with this aspect of at least one of embodiment of the invention based on the movement of the media pressure member that holds the recording media fed into the storage unit in a stack. If the total thickness is approximately equal to the width of the storage unit, the storage unit is known to be full. If the recording medium fed in between the media pressure member and the first side wall on one side of the storage unit becomes folded and jammed, the media pressure member will be pushed back greatly by the jammed medium. Jammed media can thus be detected from this large movement of the media pressure member. That the operator has removed the accumulated checks can also be known if the total thickness of the media changes from being close to the width of the storage unit to a thickness indicating there are substantially no checks in the storage unit.

The media pressure member is disposed to a second side wall on the opposite side of the storage unit as the first side wall, and extends at a predetermined angle towards the first side wall and the downstream end of the storage unit. The media pressure member can also be moved toward the second side wall by the recording media that are conveyed between the media pressure member and the first side wall. In this configuration the detection mechanism includes a detected member disposed to the media pressure member, and a detector member disposed on the path of detected member movement.

If the detected member is a detected tab that protrudes from the media pressure member toward the second side wall, the detector member can be disposed inside an opening that can receive the detected member and is formed in the second side wall.

The media pressure member can be rendered as a plurality of media pressure members, such as a first media pressure member and a second media pressure member, disposed at separate positions front to back inside the storage unit. If recording media of different lengths are conveyed into the storage unit, relatively short recording media can be held pressed and stacked against the first side wall by only the first media pressure member. If the recording medium is relatively long, the front and back ends of the recording medium are pressed and held to the first side wall by both the first and second media pressure members.

In this configuration the detection mechanism detects movement of at least the first media pressure member. More specifically, short recording media may not extend to the second media pressure member, and the storage condition can therefore be detected more reliably by detecting the displacement of only the first media pressure member.

Yet further preferably, the pressure applied to the recording media by the first media pressure member is less than the pressure applied to the recording media by the second media pressure member. If the first media pressure member thus applies less pressure, the first media pressure member moves easily when the in-fed recording medium becomes jammed, and paper jams can thus be detected quickly.

The detection mechanism can be an optical detection mechanism.

A recording media processing device according to another aspect of at least one of embodiment of the invention has the recording media storage device described above and a transportation mechanism for conveying the recording media, and the recording media are conveyed from the transportation mechanism to the recording media storage device.

A storage condition detection method for a recording media storage device wherein recording media are stacked widthwise from a side wall of a storage unit by conveying the recording media from the upstream end between one side wall of the storage unit and a media pressure member that is pressed to the side wall into a storage unit that is a slot of a predetermined depth, and detects the storage condition of the recording media in the storage unit based on the position of the media pressure member moving away from said side wall.

Examples of the detected storage conditions include the storage unit being full with the recording media, and the recording medium being jammed inside the storage unit.

At least one of embodiment of the invention thus focuses on the media pressure member that holds the recording media conveyed into the storage unit in a stack pressed against one side wall of the storage unit, and detects the movement position of the media pressure member. Because the combined total thickness of the recording media stored in the storage unit can be determined from the position of the media pressure member, whether the storage unit is full or whether there is a jam in the storage unit can be accurately detected.

Other objects and attainments together with a fuller understanding of at least one of embodiment of the invention will become apparent and appreciated by referring to the following description and claims taken in conjunction with the accompanying drawings.

DESCRIPTION OF PREFERRED EMBODIMENTS

A preferred embodiment of a check processing device according to at least one of embodiment of the present invention is described below with reference to the accompanying figures.

General Configuration

Figure 1A:
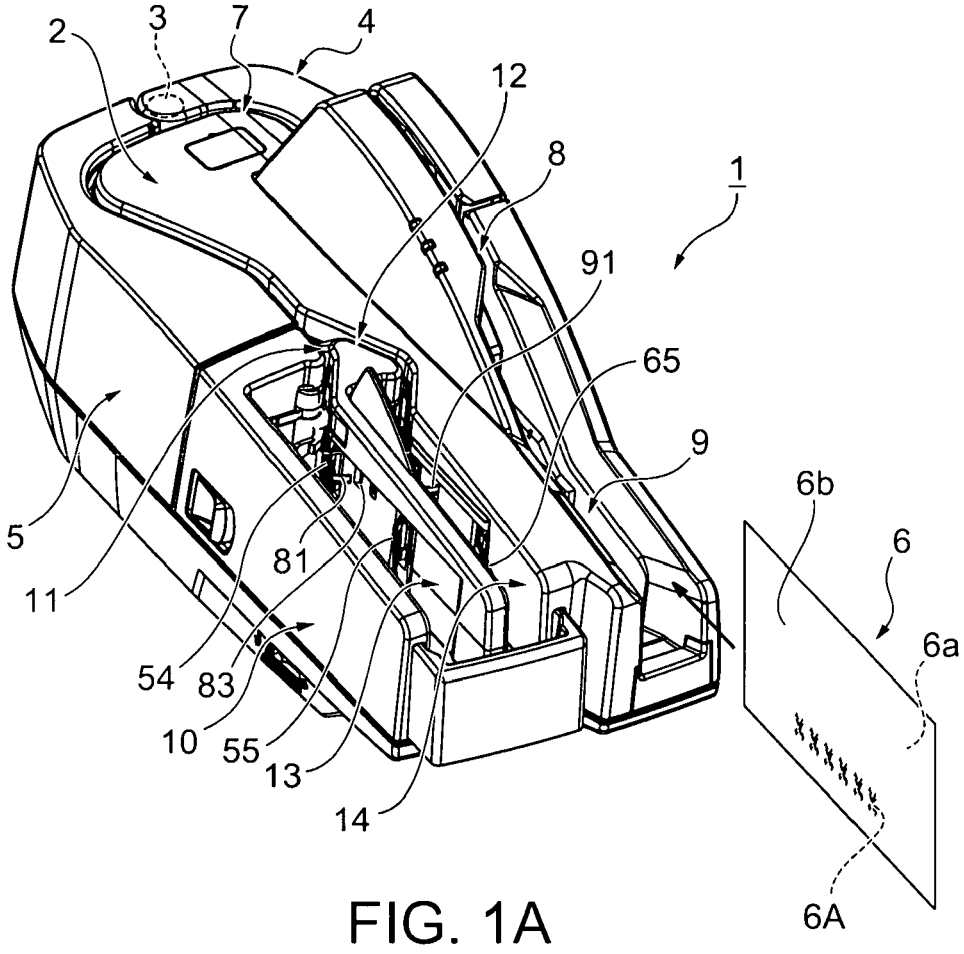
FIG. 1A is an oblique view of a check processing device according to at least one of embodiment of the present invention.
Figure 1B:
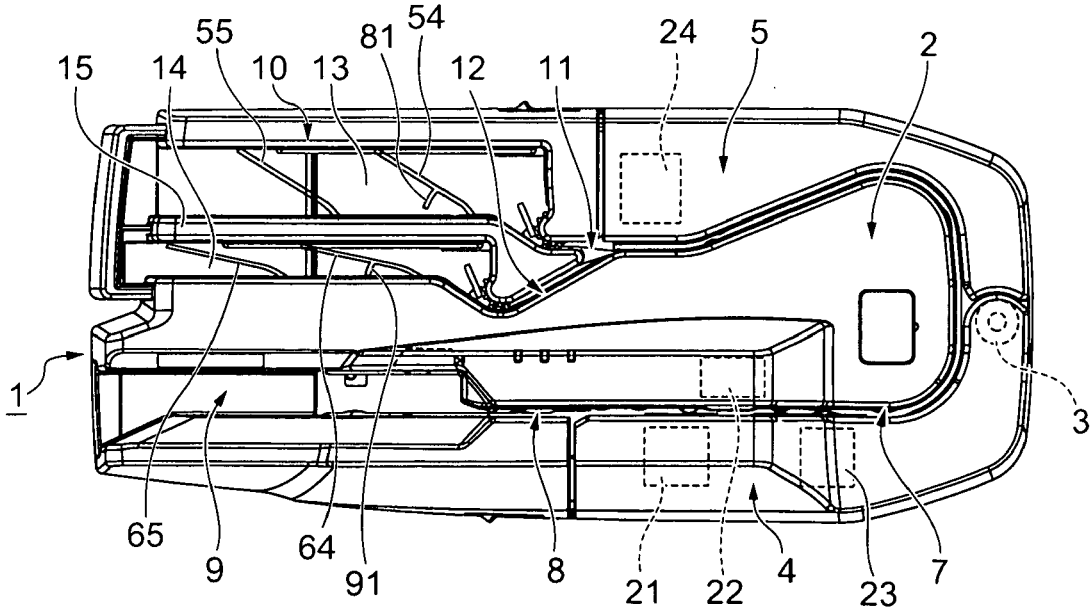
FIG. 1B is a plan view of a check processing device according to at least one of embodiment of the present invention.

FIG. 1A is an external oblique view and FIG. 1B is a plan view of a check processing device 1 according to a preferred embodiment of the invention.

The check processing device 1 has a case 2 on the main unit and a pair of left and right access covers 4 and 5 that open and close pivoting on a vertical support pin 3 disposed at the back end of the case 2. A check transportation path 7 for conveying checks 6 is formed between the case 2 and the access covers 4 and 5.

The check transportation path 7 is a narrow vertical slot that curves in a basically U-shaped configuration when seen from above. The upstream end of the check transportation path 7 in the check transportation direction is connected through a check infeed path 8 that is a narrow vertical channel to a check supply unit 9, which is a wide vertical channel. The downstream end of the check transportation path 7 is connected to a check storage unit 10.

The check storage unit 10 has first and second branch paths 11 and 12 connected to the downstream end of the check transportation path 7, and first and second storage pockets 13 and 14 connected to the downstream ends of the first and second branch paths 11 and 12.

As shown in FIG. 1A, each check 6 has an MICR line 6A printed along the long bottom edge on the front 6*a* of the check 6. Also recorded on the front 6*a* against a patterned background are the check amount, payer and payee, various numbers, and the payer signature. An endorsement is recorded on the back 6*b* of the check 6.

As indicated by the dotted lines in FIG. 1B, a front contact image scanner 21 for imaging the fronts of the checks 6, a back contact image scanner 22 for imaging the backs of the checks 6, a magnetic head 23 for reading magnetic ink characters, and a printing mechanism 24 for printing ELECTRONIC FUNDS TRANSFER, for example, on the check front are disposed in this order along the check transportation path 7.

After a check 6 is delivered from the check supply unit 9 through the check infeed path 8, the front and back sides of the check 6 are imaged and the magnetic ink character line 6A printed on the check front 6*a* is read as the check 6 travels through the check transportation path 7. If the information is read correctly, ELECTRONIC FUNDS TRANSFER or other information is printed on the check 6, and the check 6 is delivered to and stored in the first storage pocket 13. Checks 6 that cannot be scanned or read correctly are not printed and are diverted to and stored in the second storage pocket 14.

Check Storage Unit

Figure 2:
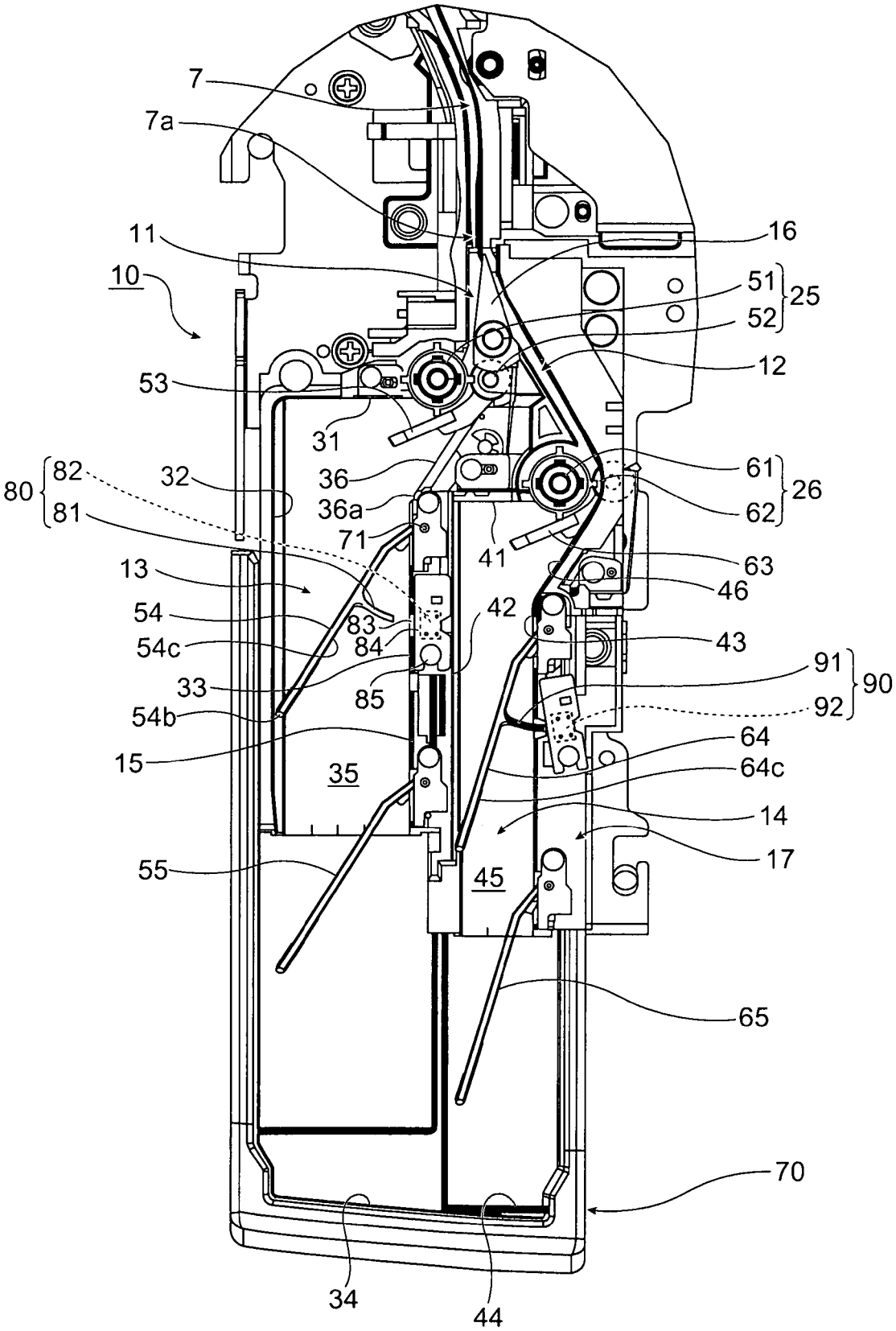
FIG. 2 is a schematic view of the check storage unit in the check processing device shown in FIG. 1.

FIG. 2 is a plan view showing the main parts of the check storage unit 10. The check storage unit 10 has first and second branch paths 11 and 12, a dividing wall 15 extending front to back in the check transportation direction (referred to as the "longitudinal direction" below), and first and second storage pockets 13 and 14 disposed on opposite sides of the dividing wall 15.

The first and second storage pockets 13 and 14 are vertical channels that are generally rectangular with the long side along the longitudinal direction of the check processing device. The first storage pocket 13 is wider than and therefore has a greater check storage capacity than the second storage pocket 14. Roller pairs 25 and 26 for feeding checks 6 into the respective storage pockets 13 and 14 are disposed to the upstream infeed ends of the storage pockets 13 and 14.

The first branch path 11 for conveying checks 6 into the first storage pocket 13 is a path that extends in the longitudinal direction and is connected in a straight line to the downstream end 7*a* of the check transportation path 7. The downstream end of the first branch path 11 continues to the nipping part of the roller pair 25.

The second storage pocket 14 for conveying checks 6 into the second storage pocket 14 is a diagonal path extending substantially straight from the downstream end 7*a* of the check transportation path 7 at an acute angle to the longitudinal direction. The downstream end of the second branch path 12 continues to the nipping part of the roller pair 26.

A switching lever 16 (flapper) for directing the in-fed check 6 to either one of the first and second branch paths 11 and 12 is disposed where the main transportation path splits into the first and second branch paths 11 and 12. The flapper 16 is normally held to the position closing the second branch path 12. When a check 6 cannot be read or a read error occurs, a motor switches the flapper 16 to close the first branch path 11 as needed so that the second branch path 12 communicates with the check transportation path 7.

The first storage pocket 13 has an upstream end wall 31, mutually parallel right and left side walls 32 and 33, a downstream end wall 34, and a bottom 35. An inclined guide surface 36 continues from the upstream end of the side wall 33 on the second storage pocket 14 side of the first storage pocket 13 so that the entrance to the first storage pocket 13 widens toward the second storage pocket 14 as the inclined guide surface 36 approaches the upstream end wall 31 of the first storage pocket 13. The roller pair 25 is located in a corner on the second storage pocket side at the wide upstream end of the inclined guide surface 36.

The second storage pocket 14 similarly has an upstream end wall 41, opposing right and left side walls 42 and 43, a downstream end wall 44, and a bottom 45. The downstream end wall 44 is continuous to the downstream end wall 34 of the first storage pocket 13. An inclined guide surface 46 continues from the upstream end of the side wall 43 on the opposite side as the first storage pocket 13 and slopes away from the other side wall 42 as the inclined guide surface 46 approaches the upstream end wall 41 of the second storage pocket 14. The roller pair 26 is located in a corner at the upstream end of the inclined guide surface 46 where the entrance to the second storage pocket 14 is wide.

The roller pair 25 of the first storage pocket 13 includes a feed roller 51 and a pressure roller 52 that applies pressure to the feed roller 51 from the side. A check guide 53 that guides conveyed checks 6 to the feed roller 51 side is disposed near the roller pair 25 inside the first storage pocket 13. The check guide 53 causes the checks 6 to be pressed against the outside of the feed roller 51 and fed reliably into the first storage pocket 13.

A first vertical pressure plate 54 and a second vertical pressure plate 55 for pushing and hold the in-fed checks 6 stacked against the side wall 32 are disposed inside the first storage pocket 13. Short checks 6 are pressed against the side wall 32 by only the first vertical pressure plate 54. Checks 6 that are long enough to reach between the second vertical pressure plate 55 and the side wall 32 are pressed to the side wall 32 by both pressure plates 54 and 55 so that the checks are held with the downstream ends neatly aligned vertically and horizontally.

The roller pair 26 of the second storage pocket 14 includes a feed roller 61 and a pressure roller 62 that applies pressure to the feed roller 61 from the side. A check guide 63 that guides conveyed checks 6 to the feed roller 61 side is disposed near the roller pair 26 inside the second storage pocket 14. The check guide 63 causes the checks 6 to be pressed against the outside of the feed roller 61 and fed reliably into the second storage pocket 14.

A first vertical pressure plate 64 and a second vertical pressure plate 65 for pushing and hold the in-fed checks 6 stacked against the side wall 42 are disposed inside the second storage pocket 14. Short checks 6 are pressed against the side wall 42 by only the first vertical pressure plate 64. Checks 6 that are long enough to reach between the second vertical pressure plate 65 and the side wall 42 are pressed to the side wall 42 by both pressure plates 64 and 65 so that the checks are held with the downstream ends neatly aligned vertically and horizontally.

Figure 3:
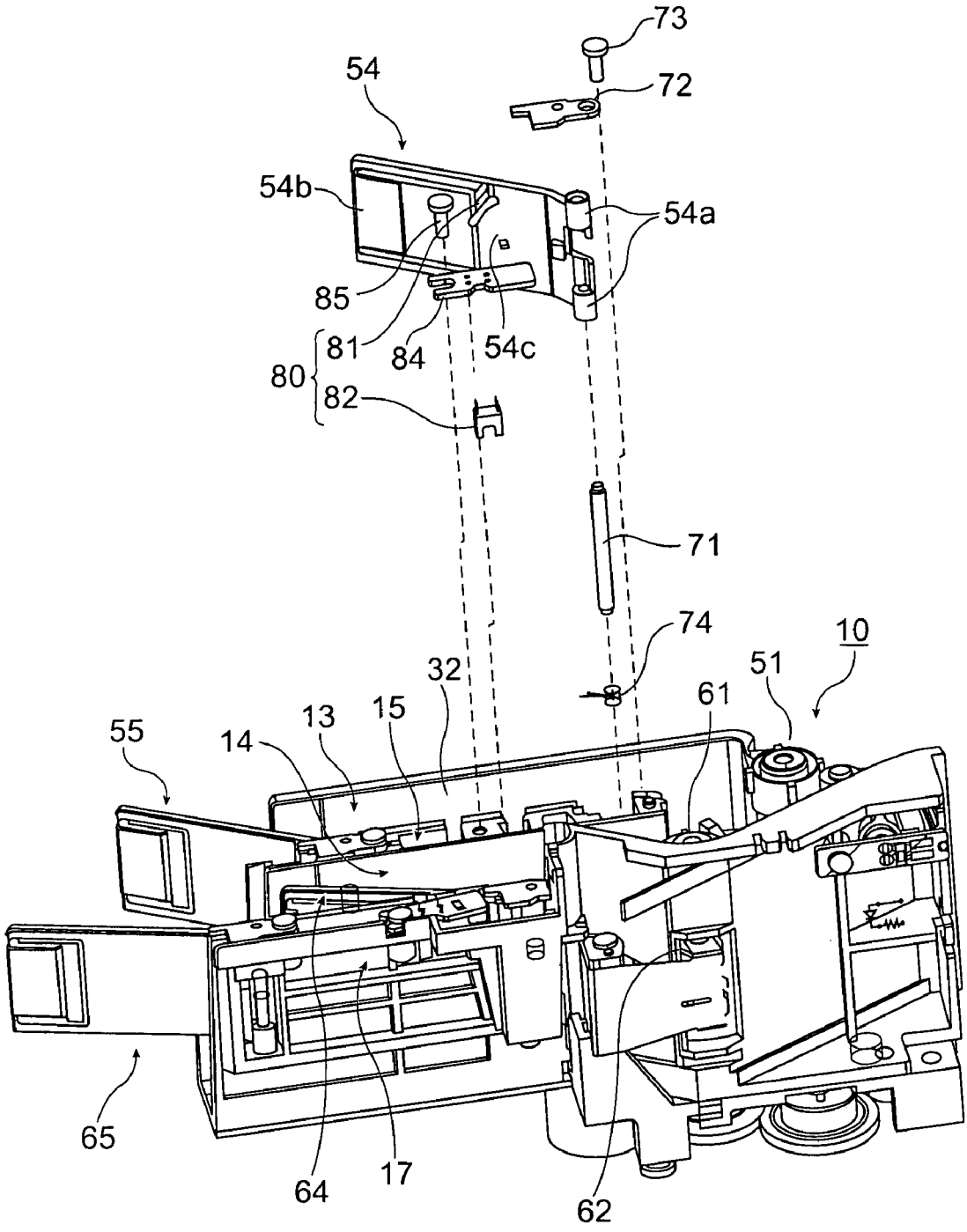
FIG. 3 is a partially exploded oblique view of the check storage unit with the first vertical pressure plate removed.
Figure 4:
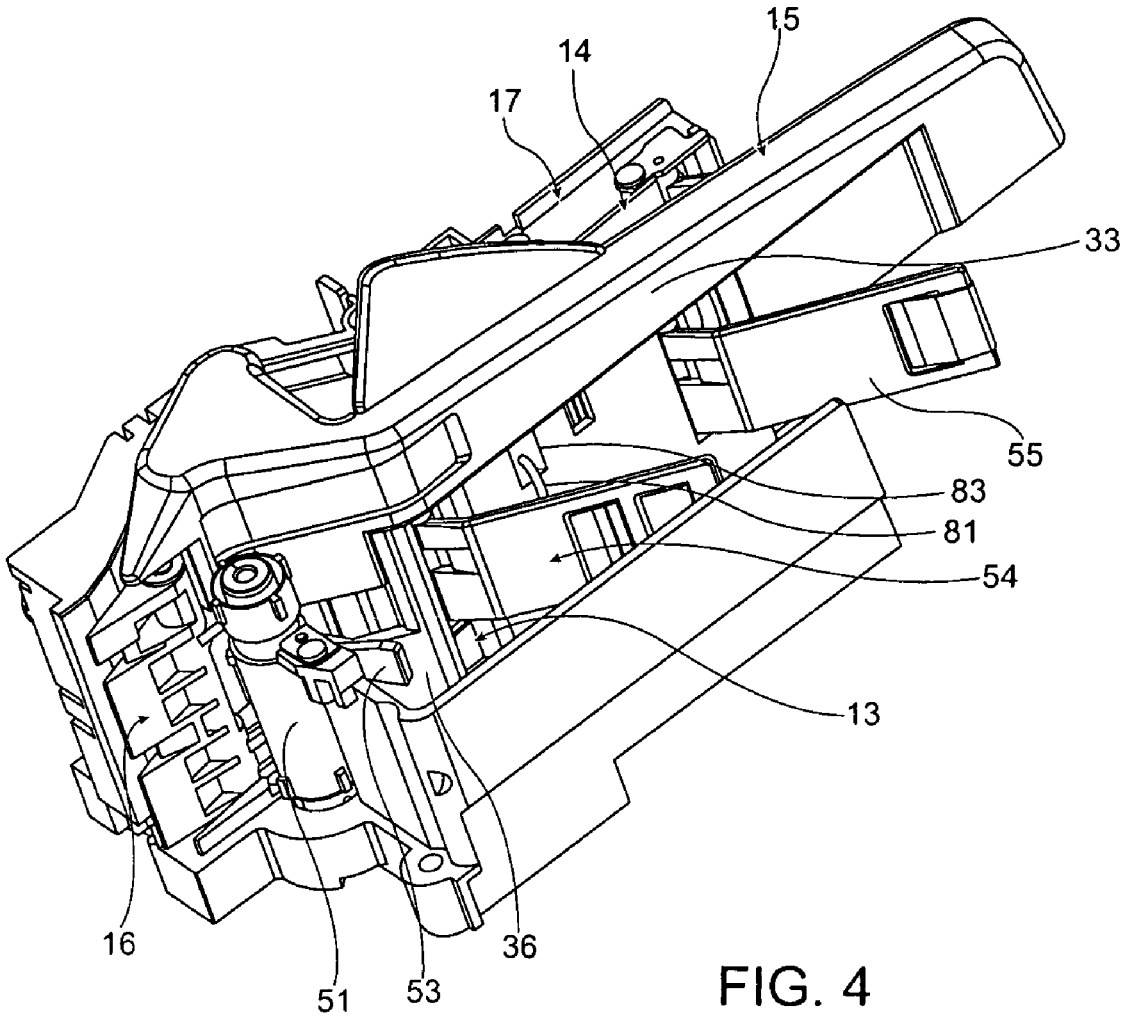
FIG. 4 is an oblique view of the check storage unit from the opposite side shown in FIG. 3.

FIG. 3 is a partially exploded oblique view showing the main parts of the check storage unit 10 with the first vertical pressure plate 54 of the first storage pocket 13 removed. FIG. 4 is an oblique view of the main parts of the check storage unit 10 from the opposite side as shown in FIG. 3.

As will be known from the figures, the first vertical pressure plate 54 is a rectangular plate having a bearing member 54*a* formed on one side end. A freely rotatable vertical support shaft 71 passes vertically through the bearing member 54*a* and dividing wall 15. A fixed plate 72 is attached by a screw 73 to the top of the dividing wall 15, and this fixed plate 72 prevents the first vertical pressure plate 54 from slipping off the vertical support shaft 71. A torsion spring 74 is disposed coaxially on the vertical support shaft 71, and the torsion spring 74 urges the first vertical pressure plate 54 toward the side wall 32 with a predetermined spring force.

The first vertical pressure plate 54 is thus attached to the side wall 33 so that it can pivot away from the other side wall 32 on the vertical support shaft 71 on the side wall 33 side, and the distal end 54*b* of the first vertical pressure plate 54 is normally pressed by the torsion spring 74 to the side wall 32. When a check 6 is conveyed to the first vertical pressure plate 54, the check 6 pushes against the first vertical pressure plate 54 while entering between the side wall 32 and the first vertical pressure plate 54. After the trailing end of the check 6 leaves the nipping part of the feed roller pair 25, the check 6 is pressed to and held vertically by the first vertical pressure plate 54 against the side wall 32. The sequentially fed checks 6 are thus held stacked on edge in the thickness direction between the side wall 32 and the first vertical pressure plate 54.

The second vertical pressure plate 55 is similarly constructed. It differs in that the urging force of the torsion spring is greater than the force applied to the first vertical pressure plate 54.

The first vertical pressure plate 64 and second vertical pressure plate 65 of the second storage pocket 14 are also constructed the same as the first vertical pressure plate 54 and second vertical pressure plate 55. The pressure applied by the first vertical pressure plate 64 is also less than the pressure applied by the second vertical pressure plate 65.

Storage Condition Detection Mechanism

The check storage unit 10 has detection mechanisms 80 and 90 for detecting the storage condition of the first and second storage pockets 13 and 14. Referring to FIG. 2 to FIG. 4, the detection mechanism 80 on the first storage pocket 13 side is an optical sensor that has an interrupter 81 (a detected member) and a photosensor 82 (a detector member). The interrupter 81 curves slightly and protrudes from the back 54*c* of the first vertical pressure plate 54 toward the side wall 33. The photosensor 82 is disposed inside the dividing wall 15. The interrupter 81 is a curved plate with an arc centered on the vertical support shaft 71, which defines the pivot axis of the first vertical pressure plate 54. A rectangular window 83 through which the interrupter 81 can pass is formed in the side wall 33 as shown in FIG. 4.

As shown in FIG. 3, the photosensor 82 is mounted on a circuit board 84, and the circuit board 84 is fastened by a screw 85 to the dividing wall 15. When thus attached the photosensor 82 is positioned inside the window 83. When the interrupter 81 penetrates the window 83 and enters the photodetection range of the photosensor 82, the interrupter 81 is detected by the photosensor 82.

The detection mechanism 90 disposed to the second storage pocket 14 is constructed in the same way, and has an interrupter 91 protruding from the back 64*c* of the first vertical pressure plate 64 toward the side wall 43, and a photosensor 92 disposed inside the side wall 17 part where the side wall 43 is rendered.

Detection Operation

Figure 5A:
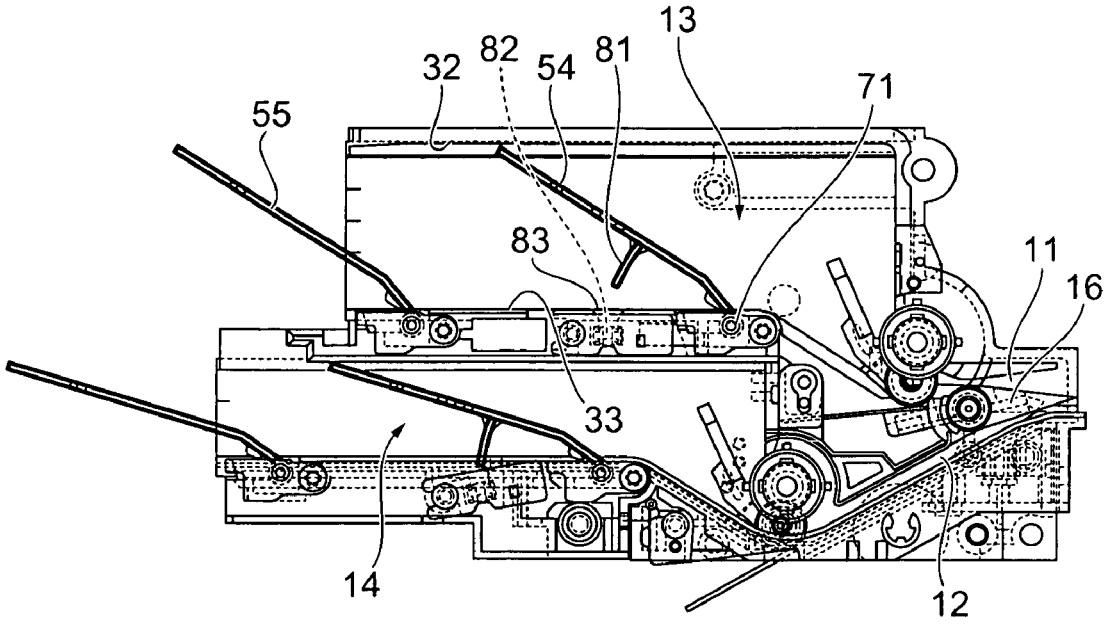
FIG. 5A describes the detection operation of the detection mechanism when the check storage unit is empty.
Figure 5B:
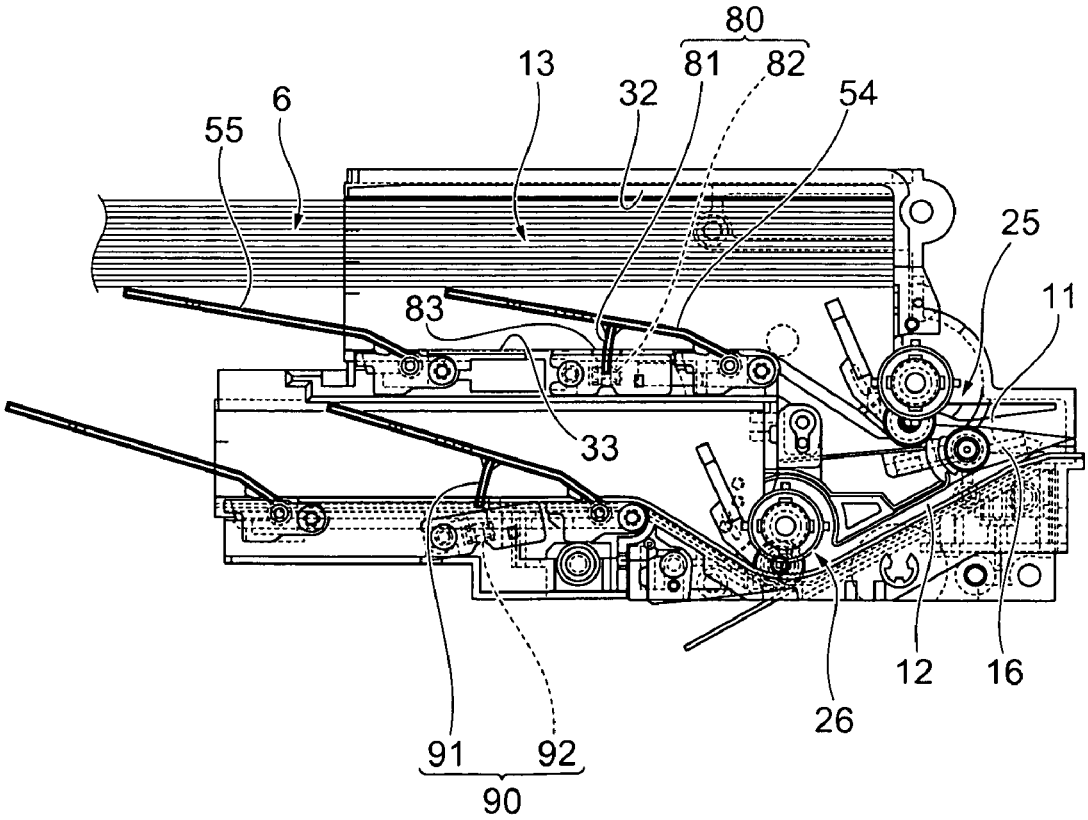
FIG. 5B describes the detection operation of the detection mechanism when the check storage unit is full.

FIG. 5A shows the first storage pocket 13 of the check storage unit 10 when empty, and FIG. 5B shows the first storage pocket 13 when full. The detection operation of the detection mechanism 80 is described next with reference to FIG. 5A and FIG. 5B.

When the first storage pocket 13 is empty as shown in FIG. 5A, the first vertical pressure plate 54 and second vertical pressure plate 55 push against the side wall 32. A check 6 fed into the first storage pocket 13 is held stacked between the side wall 32 and the first vertical pressure plate 54. If the check 6 extends to the second vertical pressure plate 55, the check 6 is held stacked between the side wall 32 and both first and second pressure plates 54 and 55. As more checks 6 are stacked (stored), the first vertical pressure plate 54 pivots on the vertical support shaft 71 toward the side wall 33. The interrupter 81 disposed to the first vertical pressure plate 54 therefore also moves toward the window 83 in the side wall 33.

When the first storage pocket 13 becomes full as shown in FIG. 5B, the interrupter 81 of the first vertical pressure plate 54 is inserted from the window 83 into the detection range of the photosensor 82. This causes the photosensor 82 to output a detection signal. That the first storage pocket 13 is full is known from this detection signal and the operator can be informed that the first storage pocket 13 is full by causing a display indicator on the check processing device 1 to flash, for example. The computer to which the check processing device 1 is connected can also be informed that the storage pocket is full.

Because the detection mechanism 90 of the second storage pocket 14 is identical, description of the detection operation is omitted.

As described above, the check storage unit 10 of the check processing device 1 has detection mechanisms 80 and 90 for detecting if the first and second storage pockets 13 and 14 are full. The detection mechanisms 80 and 90 focus on the first vertical pressure plates 54 and 64 that hold the checks 6 fed into the first and second storage pockets 13 and 14 stacked together, and detect the combined thickness of the checks 6 stored in the first and second storage pockets 13 and 14 based on the position of the pressure plates 54 and 64.

That the storage pocket is full can thus be accurately detected without being affected by differences in the thickness of the individual checks 6. If a check 6 fed into either of the first and second storage pockets 13 and 14 is folded and jams, the corresponding first vertical pressure plate 54, 64 will be pushed back greatly and the interrupter 81, 91 will be detected by the photosensor 82, 92. A check 6 jammed in either storage pocket 13, 14 can therefore be quickly detected.

Furthermore, because the detection mechanisms 80 and 90 are attached to the first vertical pressure plates 54 and 64, full storage and jammed media conditions can be detected more accurately than if the detection mechanisms 80 and 90 are disposed to the second vertical pressure plates 55 and 65. For example, if a short check 6 that does not extend to the second vertical pressure plate 55, 65 is fed in, the second vertical pressure plates 55 and 65 will not move to a position accurately reflecting the check thickness, and may therefore not be able to detect that the storage pocket 13, 14 is full. It may also not be possible to detect if a check is jammed on the upstream side of the storage pockets 13 and 14. The arrangement described in this embodiment of the invention avoids both of these problems.

The pressure required by the first vertical pressure plates 54 and 64 to hold the checks stacked is also less than the pressure required by the second vertical pressure plates 55 and 65. A jammed check therefore also pushes the first vertical pressure plates 54 and 64 back more easily, and jammed media can be detected with greater sensitivity.

The detection mechanism is disposed only to the first vertical pressure plate in this aspect of the invention, but detection mechanisms can be disposed to both the first and second pressure plates. In this case jammed media can be detected when displacement of the first vertical pressure plate is great but the second vertical pressure plate does not move.

The detection mechanism can be a transmission or reflection type of optical sensor. The detection mechanism is also not limited to an optical sensor, and a mechanical switch, for example, can be used instead.

The invention can also be used as a storage device for a recording media processing device that processes recording media other than checks, promissory notes, invoices, and the like. For example, the invention can be used as a recording media storage device that is used with a recording media processing device such as a printer or scanner.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording media storage device comprising:

a storage unit that has mutually opposing first and second side walls and stores recording media;

first and second media pressure members that press recording media conveyed into the storage unit against the first side wall; and a detection mechanism that detects a distance that at least one of the first and second media pressure members moves across the width of the storage unit;

wherein the first media pressure member and the second media pressure member are disposed at separate positions one before the other inside the storage unit; and wherein the pressure applied to the recording media by the first media pressure member is less than the pressure applied to the recording media by the second media pressure member.

2. The recording media storage device described in claim 1, wherein:

the first media pressure member is disposed to the second side wall and extends at a predetermined angle of inclination toward the first side wall;

the first media pressure member is moved by recording media conveyed between the first media pressure member and the first side wall; and the detection mechanism includes a detected member disposed to the first media pressure member, and a detector member disposed on the path of detected member movement.

3. The recording media storage device described in claim 1, wherein:

the detection mechanism includes a detected member disposed to the first media pressure member, and a detector member disposed on the path of detected member movement;

the detected member is a detected tab that protrudes from the first media pressure member toward the second side wall; and the detector member is disposed inside an opening that can receive the detected member and is formed in the second side wall.

4. The recording media storage device described in claim 1, wherein:

a plurality of media pressure members are disposed in sequence front to back inside the storage unit; and the detection mechanism detects movement of at least one of the media pressure members.

5. A recording media processing device comprising:

the recording media storage device described in claim 1; and a transportation mechanism for conveying the recording media;

wherein the recording media are conveyed from the transportation mechanism to the recording media storage device.

6. A storage condition detection method for a recording media storage device wherein:

recording media are stacked widthwise from a side wall of a storage unit by conveying the recording media between the side wall of the storage unit and first and second media pressure members pressed to the side wall, the first and second media pressure members being disposed at separate positions one before the other inside the storage unit and being configured such that the pressure applied to the recording media by the first media pressure member is less than the pressure applied to the recording media by the second media pressure member; and the storage condition of the recording media in the storage unit is detected by a detection mechanism based on the position of at least one of the first and second media pressure members moving away from said side wall.

7. The storage condition detection method for a recording media storage device described in claim 6, wherein:

the storage condition is the storage unit being full with the recording media.

8. The storage condition detection method for a recording media storage device described in claim 6, wherein:

the storage condition is the recording medium being jammed inside the storage unit.

* * * * *